US007002069B2

(12) United States Patent
Desai et al.

(10) Patent No.: US 7,002,069 B2
(45) Date of Patent: Feb. 21, 2006

(54) BALANCING MIDI INSTRUMENT VOLUME LEVELS

(75) Inventors: Adarsh S. Desai, Parkland, FL (US); Marc Andre Boillot, Plantation, FL (US); Radu C. Frangopol, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 144 days.

(21) Appl. No.: 10/796,493

(22) Filed: Mar. 9, 2004

(65) Prior Publication Data

US 2005/0211075 A1 Sep. 29, 2005

(51) Int. Cl.
*G10H 7/00* (2006.01)

(52) U.S. Cl. ..... 84/645; 84/633

(58) Field of Classification Search ..... 84/633, 84/645, 665

See application file for complete search history.

(56) References Cited

U.S. PATENT DOCUMENTS 6,150,599 A * 11/2000 Fay et al. ..... 84/609
2002/0010740 A1 1/2002 Kikuchi et al.
2003/0027604 A1 2/2003 Hayashi

FOREIGN PATENT DOCUMENTS

JP 2001197585 7/2001
JP 2002258841 9/2002

* cited by examiner

*Primary Examiner*—Jeffrey W Donels

(57) ABSTRACT

A system, method and computer readable medium for adjusting volume levels of a Musical Instrument Digital Interface (MIDI) sound file for optimizing play on a sound device. The method on an information processing system includes calculating a first set of loudness levels for each instrument in a MIDI sound file and calculating a second set of loudness levels corresponding to an audio output range of a sound device. The method further includes generating a mapping between the first set of loudness levels and the second set of loudness levels corresponding to the audio output range of the sound device. The method further includes generating a gain term for each note in the MIDI sound file and modifying the MIDI sound file using the second set of loudness levels and the gain term for each note in the MIDI sound file.

20 Claims, 6 Drawing Sheets

BALANCING MIDI INSTRUMENT VOLUME LEVELS

FIELD OF THE INVENTION

The present invention generally relates to the field of wireless devices, and more particularly relates to balancing MIDI instrument volume levels on wireless devices.

BACKGROUND OF THE INVENTION

With the advent of pagers and mobile phones the wireless service industry has grown into a multi-billion dollar industry. The Cellular Telecommunications and Internet Association calculates that 120 million Americans own a mobile telephone—about half of the U.S. population. As the development and availability of mobile telephones progresses the benefits of mobile telephones are reaching more and more people. The online availability of ring tones and songs for download via a personal computer (PC) and transfer to a mobile telephone has also enjoyed increasing popularity. Mobile telephone users prefer to download their own ring tones or songs instead of being restricted to the limited amount of sounds provided on a mobile telephone upon purchase. This feature, however, has not come without its drawbacks.

A complaint of mobile telephone users is that downloaded Musical Instrument Digital Interface (MIDI) ring tones and songs do not sound the same or at the same relative volume level on a PC as they do on a mobile telephone. MIDI is a hardware specification and protocol used to communicate note and effect information between sound/music synthesizers, computers, music keyboards, controllers, and other electronic music devices. The basic unit of information in the MIDI protocol is a "note on/off" event which includes a note number (pitch) and key velocity (loudness). There are also other message types for events such as pitch bend, patch changes and synthesizer-specific events for loading new patches etc. There is a file format for expressing MIDI data which is a dump of data sent over a MIDI port.

Because of the manner in which MIDI ring tones and songs are played on different devices, sounds often play differently or at disparate relative volume levels on a PC as they do on a mobile telephone. This is because a MIDI player is a proprietary design with its own frequency modulation synthesis techniques and its own instrument sets, each of which have a default volume level. Since each instrument has a particular volume level that is dependent on the playing device's synthesis technique, it is not possible to assess the perceptual volume difference of a MIDI sound until it is present on the playing device.

Related to this, mobile telephone users have expressed a strong desire to be able to load their own original ring tones and songs into their mobile telephones. Normally, the original ring tones and songs are not optimized for the mobile telephone on which it is loaded, leading to distorted sounding tones and increased customer complaints.

Therefore a need exists to overcome the problems with the prior art as discussed above.

SUMMARY OF THE INVENTION

Briefly, in accordance with the present invention, disclosed is a system, method and computer readable medium for adjusting volume levels of a Musical Instrument Digital Interface (MIDI) sound file for optimizing play on a sound device. In an embodiment of the present invention, the method on an information processing system includes calculating a first set of loudness levels for each instrument in a MIDI sound file and calculating a second set of loudness levels corresponding to an audio output range of a sound device. The method further includes generating a mapping between the first set of loudness levels and the second set of loudness levels corresponding to the audio output range of the sound device. The method further includes generating a gain term for each note in the MIDI sound file and modifying the MIDI sound file using the second set of loudness levels and the gain term for each note in the MIDI sound file.

In another embodiment of the present invention, an information processing system for adjusting volume levels of a MIDI sound file for optimizing play on a sound device is disclosed. The information processing system includes a processor for performing the steps of calculating a first set of loudness levels for each instrument in the MIDI sound file and calculating a second set of loudness levels corresponding to an audio output range of the sound device. The processor further performs the step of generating a mapping between the first set of loudness levels and the second set of loudness levels corresponding to the audio output range of the sound device. The processor further performs the steps of generating a gain term for each note in the MIDI sound file and modifying the MIDI sound file using the second set of loudness levels and the gain term for each note in the MIDI sound file.

In another embodiment of the present invention, a server for adjusting volume levels of a MIDI sound file for optimizing play on a sound device, wherein the server is connected to a wireless network, is disclosed. The server includes a processor for performing the steps of calculating a first set of loudness levels for each instrument in the MIDI sound file and calculating a second set of loudness levels corresponding to an audio output range of the sound device. The processor further performs the step of generating a mapping between the first set of loudness levels and the second set of loudness levels corresponding to the audio output range of the sound device. The processor further performs the steps of generating a gain term for each note in the MIDI sound file and modifying the MIDI sound file using the second set of loudness levels and the gain term for each note in the MIDI sound file. Further, the server includes a transmitter for transmitting the MIDI sound file that was modified to a sound device via the wireless network.

The preferred embodiments of the present invention are advantageous because they disclose a method by which automatic gain control is applied to each instrument in a MIDI sound file in an attempt to reduce the dynamic range of the synthesized sounds to a level within the nominal range of the playing device's audio output level. This allows users of audio playing devices, such as mobile telephones, the freedom to play any MIDI sound files on their audio playing device regardless of the origination of the MIDI sound file.

The present invention is further advantageous because it allows a user who has developed his own custom MIDI sound file to load it onto any audio playing device and have the volume levels of the MIDI sound files automatically adjusted for the specification of the audio playing device. The user is further able to use a computer, such as a PC, to preview what the MIDI sound file would sound like on the audio playing device prior to the actual purchase and download of the MIDI sound file. This capability greatly enhances the audio playing device personalization experience a user would leverage to differentiate and express himself.

The present invention is further advantageous because it allows a user to select a MIDI sound file for download and automatically effectuates the processing of the MIDI sound file in order to balance instrument volume levels. Consequently, the downloaded song retains the original volume level differences between instruments and sounds balanced in terms of instrument volumes.

DETAILED DESCRIPTION

The present invention, according to a preferred embodiment, overcomes problems with the prior art by providing a system and method for balancing MIDI instrument volume levels.

Introduction

The method of the present invention includes scanning a MIDI file before it is transferred or downloaded to the device on which it will be played, such as a mobile telephone or a PC. The scan generates volume level statistics of each instrument based on an instrument mapping of a loudness scale. The volume level of each instrument is automatically adjusted based on these statistics and the playing device's dynamic range level. The present invention utilizes a psychoacoustic mapping procedure that associates each instrument level with a subjectively equivalent volume level on the playing device. Each instrument volume is independently adjusted so as to achieve an instrument volume difference which is similar to that heard on another playing device, such as a PC. The present invention effectuates an automatic adjustment of the instrument volume levels to preserve the way the MIDI sound file, such as a song or a ring tone, sounds on the playing device as it was originally intended to sound.

Briefly, the present invention provides a multi-step process for converting a MIDI sound file to execute on a playing device, such as a mobile telephone. In a first step, the loudness for each instrument and note in the MIDI file is calculated with respect to the platform where the MIDI sound was composed. In a second step, the loudness on the playing device is calculated to account for the frequency response of the audio line up. In a third step, a table is generated for mapping between the original loudness values and the playing device loudness values for each instrument and note in the MIDI file. In a fourth step, the gain terms are calculated to compensate for the differences in loudness in the table of the third step. In a fifth step, the MIDI file is processed with the gain terms obtained in the fourth step to adjust the volumes.

The Wireless System

Figure 1:
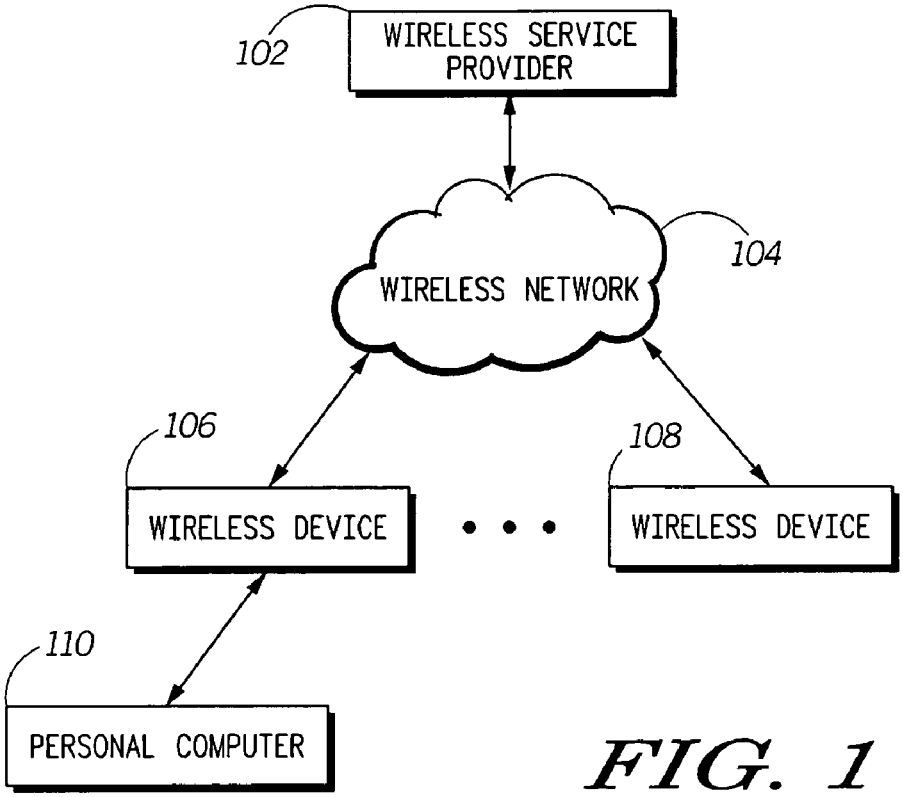
FIG. 1 is a block diagram illustrating a wireless communication system according to a preferred embodiment of the present invention.

FIG. 1 is a block diagram illustrating a wireless communication system according to a preferred embodiment of the present invention. The exemplary wireless communication system of FIG. 1 includes a wireless service provider 102, a wireless network 104 and wireless devices 106 through 108, also known as subscriber units. The wireless service provider 102 is a first-generation analog mobile phone service, a second-generation digital mobile phone service or a third-generation Internet-capable mobile phone service. The exemplary wireless network 104 is a mobile telephone network, a mobile text messaging device network, a pager network, or the like. Further, the communications standard of the wireless network 104 of FIG. 1 is Code Division Multiple Access (CDMA), Time Division Multiple Access (TDMA), Global System for Mobile Communications (GSM), General Packet Radio Service (GPRS), Frequency Division Multiple Access (FDMA) or the like.

The wireless network 104 supports any number of wireless devices 106 through 108, which are mobile phones, push-to-talk mobile radios, text messaging devices, handheld computers, pagers, beepers, or the like. Wireless devices 106 through 108 may also be a personal digital assistant, a smart phone, a watch or any other MIDI compliant device. FIG. 1 further shows a personal computer (PC) 110 connected to the wireless device 106. The PC 110 can be used as a repository of MIDI sound files, such as ring tones or songs, which are downloaded from another source, such as the World Wide Web, or are created on the PC 110. Via a connection between the PC 110 and the wireless device 106, such as a serial connection, MIDI files can be transferred or uploaded from the PC 110 to the wireless device 106. An example of a software component that can be used to effectuate such a transfer is described in greater detail below.

In another embodiment of the present invention, MIDI sound files are downloaded by the wireless device 106 itself. In this embodiment, the wireless device 106 can be Web enabled, allowing the wireless device 106 to download MIDI sound files, such as ring tones or songs, from the World Wide Web. Alternatively, the wireless device 106 can download MIDI sound files from the wireless server provider 102 or from a server connected to the wireless service provider 102.

In yet another embodiment of the present invention, MIDI sound files are transferred to the wireless device 106 from another wireless device. In this embodiment, via a connection between the wireless device 106 and another wireless device, such as a serial connection, an infrared connection or a wireless Bluetooth connection, MIDI files can be transferred or uploaded from another wireless device to the wireless device 106. An example of a software component that can be used to effectuate such a transfer is described in greater detail below.

In yet another embodiment of the present invention, MIDI sound files that are transferred to the wireless device 106 (whether from another wireless device, a PC, the World Wide Web or service provider 102) are modified so as to adjust the volume levels for optimal play on the wireless device 106. Modification of the MIDI sound file can occur at the wireless device 106 or the source of origin of the MIDI sound file, i.e., another wireless device, a PC, the World Wide Web or service provider 102. The manner in which a MIDI sound file is modified so as to adjust the volume levels for optimal play on the wireless device 106 is described in greater detail below.

Figure 2:
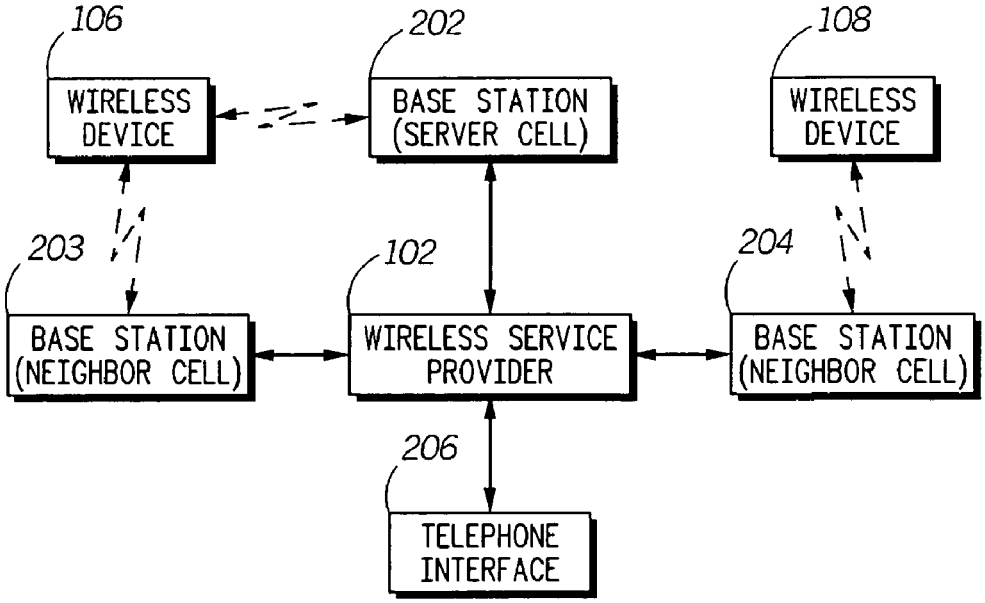
FIG. 2 is a more detailed block diagram of the wireless communication system of FIG. 1.

FIG. 2 is a more detailed block diagram of the conventional wireless communication system of FIG. 1. The wireless communication system of FIG. 2 includes the wireless service provider 102 coupled to base stations 202, 203, and 204, which represent the wireless network 104 of FIG. 1. The base stations 202, 203, and 204 individually support portions of a geographic coverage area containing subscriber units or transceivers (i.e., wireless devices) 106 and 108 (see FIG. 1). The wireless devices 106 and 108 interface with the base stations 202, 203, and 204 using a communication protocol, such as CDMA, FDMA, CDMA, GPRS and GSM. The wireless service provider 102 is interfaced to an external network (such as the Public Switched Telephone Network) through a telephone interface 206.

The geographic coverage area of the wireless communication system of FIG. 2 is divided into regions or cells, which are individually serviced by the base stations 202, 203, and 204 (also referred to herein as cell servers). A wireless device operating within the wireless communication system selects a particular cell server as its primary interface for receive and transmit operations within the system. For example, wireless device 106 has cell server 202 as its primary cell server, and wireless device 108 has cell server 204 as its primary cell server. Preferably, a wireless device selects a cell server that provides the best communication interface into the wireless communication system.

Ordinarily, this will depend on the signal quality of communication signals between a wireless device and a particular cell server. As a wireless device moves between various geographic locations in the coverage area, a hand-off or hand-over may be necessary to another cell server, which will then function as the primary cell server. For example, as wireless device 106 moves closer to base station 203, base station 202 hands off wireless device 106 to base station 203. A wireless device monitors communication signals from base stations servicing neighboring cells to determine the most appropriate new server for hand-off purposes. Besides monitoring the quality of a transmitted signal from a neighboring cell server, the wireless device also monitors the transmitted color code information associated with the transmitted signal to quickly identify which neighbor cell server is the source of the transmitted signal.

Figure 3:
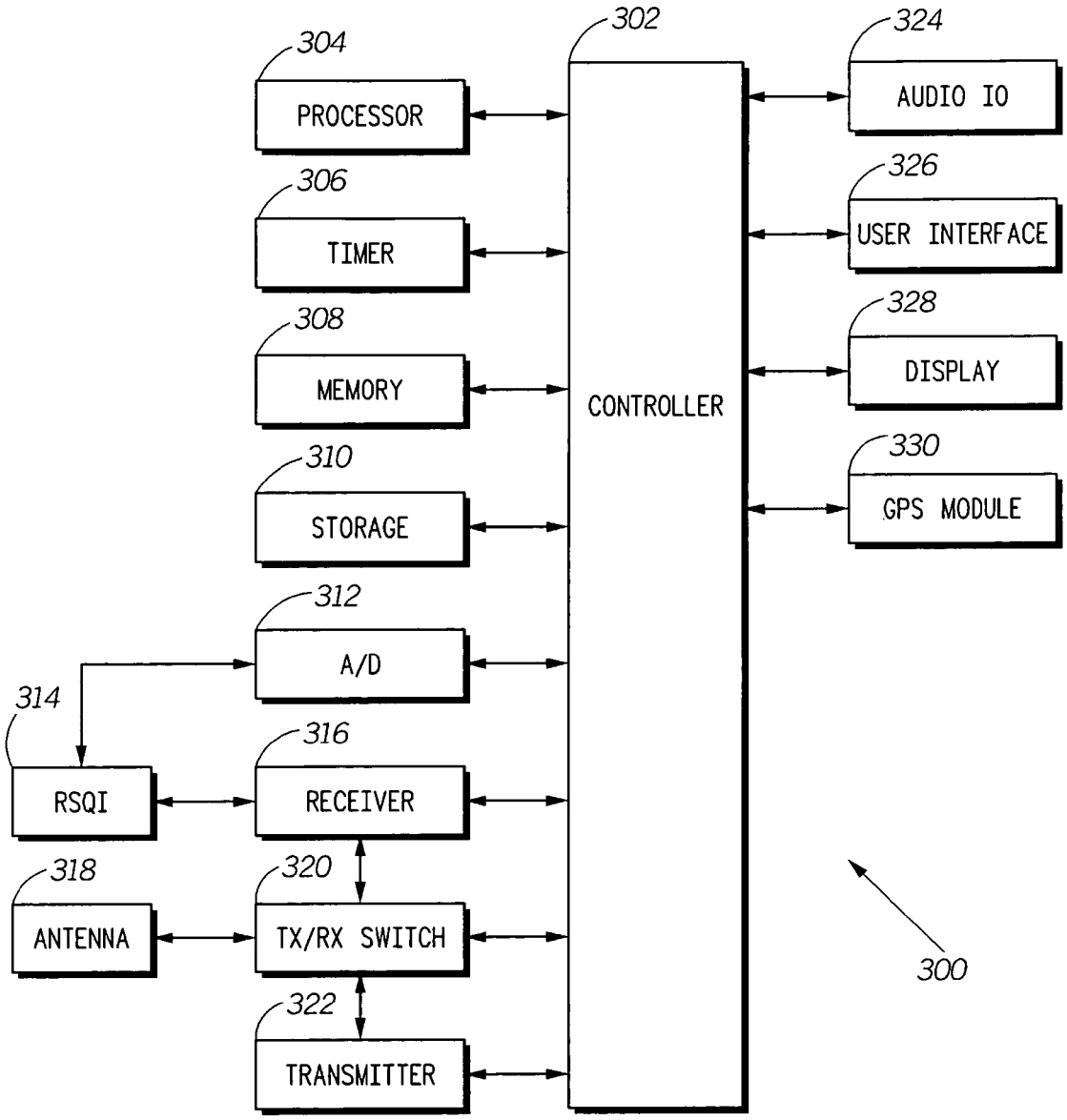
FIG. 3 is a block diagram illustrating a wireless device according to a preferred embodiment of the present invention.

FIG. 3 is a block diagram illustrating a wireless device 300 according to a preferred embodiment of the present invention. FIG. 3 shows a mobile telephone wireless device 300. In one embodiment of the present invention, the wireless device 300 is a two-way radio capable of receiving and transmitting radio frequency signals over a communication channel under a communications protocol such as CDMA, FDMA, TDMA, GPRS and GSM or the like.

The wireless device 300 operates under the control of a controller 302, or processor, which performs various functions such as the functions attributed to the multiplayer game, as described below. In various embodiments of the present invention, the processor 302 in FIG. 3 comprises a single processor or more than one processor for performing the tasks described below. FIG. 3 also includes a storage module 310 for storing information that may be used during the overall processes of the present invention. The controller 302 further switches the wireless device 300 between receive and transmit modes. In receive mode, the controller 302 couples an antenna 318 through a transmit/receive switch 320 to a receiver 316. The receiver 316 decodes the received signals and provides those decoded signals to the controller 302. In transmit mode, the controller 302 couples the antenna 318, through the switch 320, to a transmitter 322.

The controller 302 operates the transmitter 322 and receiver 316 according to instructions stored in memory 308. These instructions include a neighbor cell measurement-scheduling algorithm. In preferred embodiments of the present invention, memory 308 comprises any one or any combination of non-volatile memory, Flash memory or Random Access Memory. A timer module 306 provides timing information to the controller 302 to keep track of timed events. Further, the controller 302 utilizes the time information from the timer module 306 to keep track of scheduling for neighbor cell server transmissions and transmitted color code information.

When a neighbor cell measurement is scheduled, the receiver 316, under the control of the controller 302, monitors neighbor cell servers and receives a "received signal quality indicator" (RSQI). An RSQI circuit 314 generates RSQI signals representing the signal quality of the signals transmitted by each monitored cell server. Each RSQI signal is converted to digital information by an analog-to-digital converter 312 and provided as input to the controller 302. Using the color code information and the associated received signal quality indicator, the wireless device 300 determines the most appropriate neighbor cell server to use as a primary cell server when hand-off is necessary.

In one embodiment, the wireless device 300 is a wireless telephone. For this embodiment, the wireless device 300 of FIG. 3 further includes an audio/video input/output module 324 for allowing the input and output of audio and/or video via the wireless device 300. This includes a microphone for input of audio and a camera for input of still image and video. This also includes a speaker for output of audio and a display for output of still image and video. Also included is a user interface 326 for allowing the user to interact with the wireless device 300, such as modifying address book information, interacting with call data information, making/answering calls and interacting with a game. The interface 326 includes a keypad, a touch pad, a touch sensitive display or other means for input of information. Wireless device 300 further includes a display 328 for displaying information to the user of the mobile telephone.

FIG. 3 also shows an optional Global Positioning System (GPS) module 330 for determining location and/or velocity information of the wireless device 300. This module 330 uses the GPS satellite system to determine the location and/or velocity of the wireless device 300. Alternative to the GPS module 330, the wireless device 300 may include alternative modules for determining the location and/or velocity of wireless device 300, such as using cell tower triangulation and assisted GPS.

Units of Sound Measurement

In general, noise consists of sound at many different frequencies across the entire audible spectrum. As the human ear is more sensitive to certain frequencies than others, the level of disturbance is dependant on the particular spectral content of the noise. There are several different ways of objectively determining how noisy a sound is perceived to be. A significant amount of research has been performed in this area and there are a number of accepted techniques in use.

The human ear is most sensitive to sounds in the 500 Hz to 4000 Hz frequency range and less so for sounds above and below those frequencies. This area of sensitivity corresponds to the human speech band. This non-uniformity in the human ear's response means that the threshold of audibility for sounds of different frequencies will vary. Thus, by referencing an objectively measured sound level, the human ear's frequency response is not considered. In order to take this into consideration, a further modification of objectively measured sound levels is required.

Figure 4:
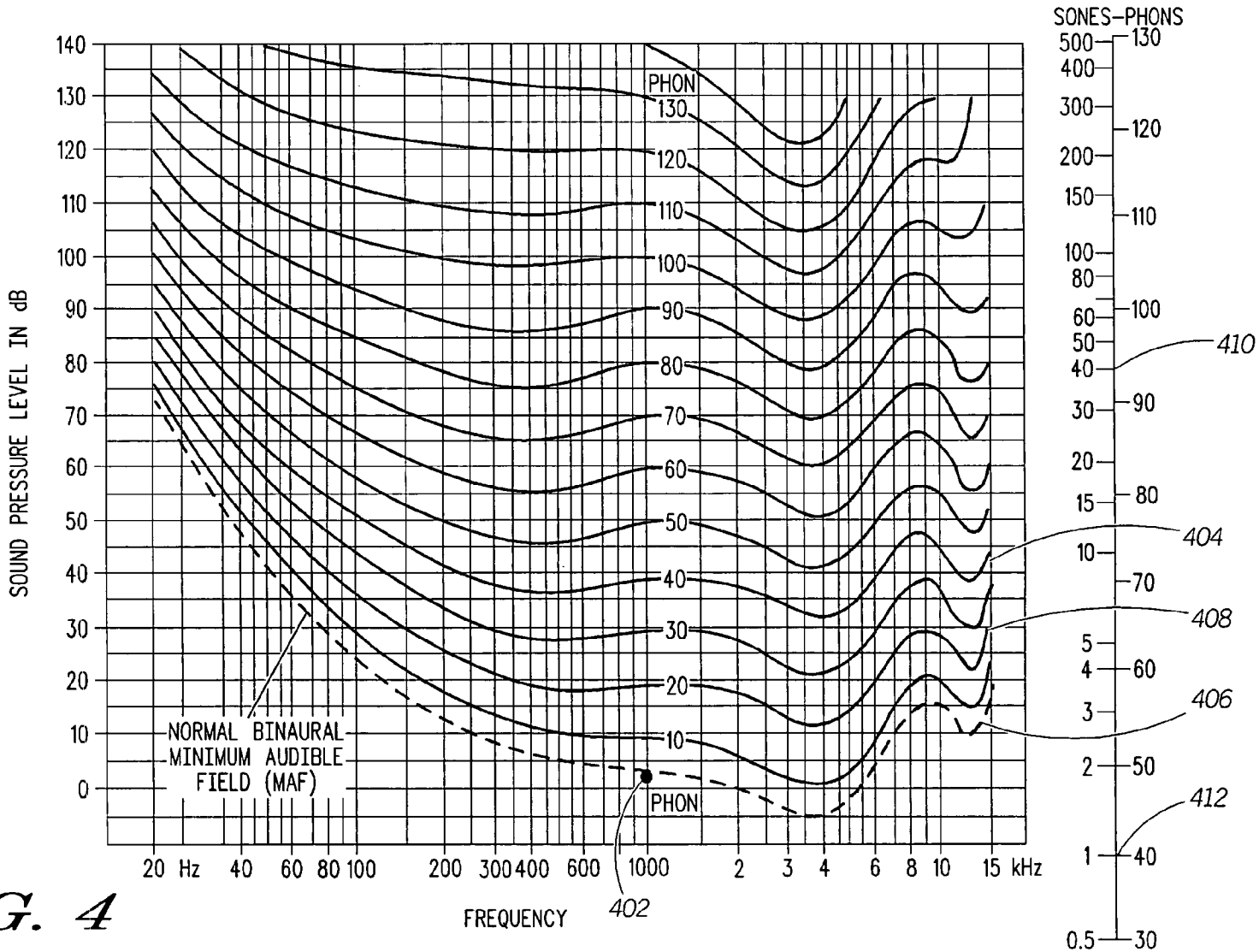
FIG. 4 is a graph illustrating equal loudness contours in addition to their relationship with sones and phons.

FIG. 4 is a graph illustrating equal loudness contours in addition to their relationship with sones and phons. A 1000 Hz tone at the threshold of audibility is used as a reference (see point 402). The threshold of other frequencies can then be determined and plotted on a graph. If the 1000 Hz tone is increased to 40 dB, for example, other frequencies could be adjusted until they were judged equally as loud (see contour line 404). Thus a set of equal loudness contours could be generated, defining a new scale, the loudness level, whose units are the phon. See FIG. 4 for a set of equal loudness contours, such as contour 404.

A phon is a unit used to describe the loudness level of a given sound or noise. The phon system of sound measurement is based on equal loudness contours, where 0 phons at 1,000 Hz are set at 0 decibels, the threshold of hearing at that frequency. The hearing threshold of 0 phons then lies along the lowest equal loudness contour (see contour 406). If the intensity level at 1,000 Hz is raised to 20 dB, the contour curve 408 is followed.

It will be noted, therefore, that the relationship between the decibel and phon scale at 1,000 Hz is exact, but because of the way the ear discriminates against or in favor of sounds of varying frequencies, the phon curve varies considerably. For instance, a very low 30 Hz rumble at 110 dBs is perceived as being only 90 phons.

The phon is used only to describe sounds that are equally loud. It cannot be used to measure relationships between sounds of differing loudness. For instance, 40 phons are not twice as loud as 20 phons. In fact, an increase of 10 phons is sufficient to produce the impression that a sine tone is twice as loud.

As the apparent loudness of a sound is not directly proportional to the sounds loudness level (a doubling of subjective loudness results in an average increase of about 6 phons), subjective experiments have been performed in order to establish a scale on which a doubling of the number of loudness units doubles the subjective loudness, a trebling of loudness units trebles the subjective loudness, and so on.

For the purpose of measuring sounds of different loudness, the sone scale of subjective loudness was invented. See scale 410 of FIG. 4. One sone is arbitrarily taken to be 40 phons at any frequency (see point 412), i.e. at any point along the 40 phon curve on the graph. Two sones are twice as loud, e.g. 40+10 phons=50 phons. Four sones are twice as loud again, e.g. 50+10 phons=60 phons. The relationship between phons and sones is shown in the chart 410, and is expressed by the equation: Phon=40+10 log2 (Sone)

MIDI Sound File Transformation

Currently, MIDI sound file volume levels cannot be changed unless they are done so in a professional software composition environment. The changes must be done manually and there is no way to hear the changes for verification until it is loaded onto the audio playing device or played through a MIDI emulator i.e., a custom MIDI synthesizer.

Figure 5:
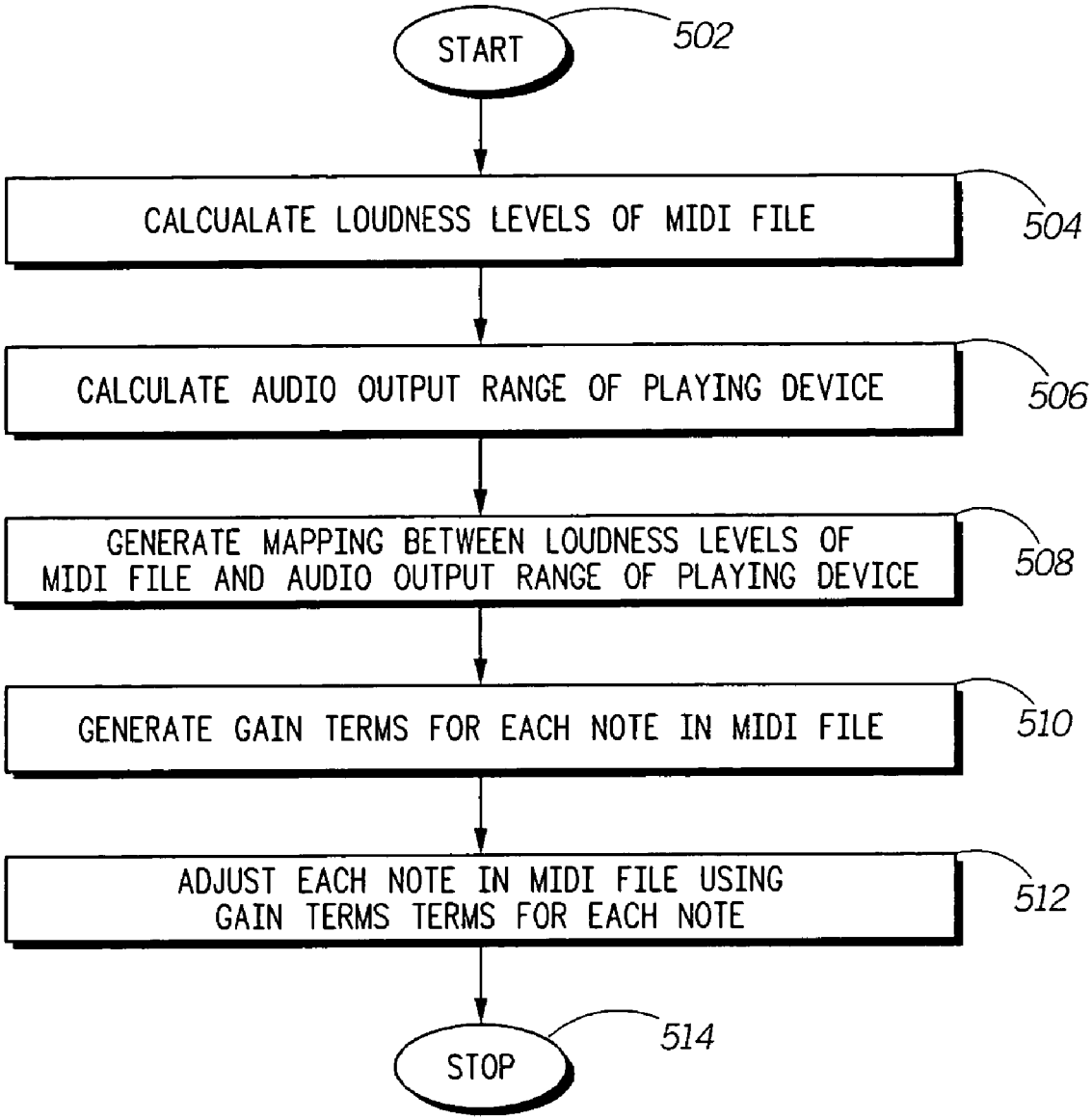
FIG. 5 is an operational flow diagram depicting the MIDI sound file transformation process, according to a preferred embodiment of the present invention.

FIG. 5 is an operational flow diagram depicting the MIDI sound file transformation process, according to a preferred embodiment of the present invention. The operational flow diagram of FIG. 5 depicts the process of balancing the volume levels of a MIDI sound file for optimizing play on a sound playing device, such as a mobile telephone or a personal computer. The operational flow diagram of FIG. 5 begins with step 502 and flows directly to step 504.

In step 504, the loudness levels of each instrument in the MIDI sound file are calculated. In this step, the MIDI sound file is scanned. A MIDI sound file is a text file that contains play list information such as what note to play, on what instrument, at what time, and for how long. A MIDI file also contains instrument synthesis parameters such as the volume level. In step 504, the text of the MIDI file is scanned for instrument volume level settings and any other changes to instrument volume levels. The result of step 504 is a list of the instruments and their corresponding volume levels over the course of the song or ring tone before it is played.

It should be noted that step 504 calculates the loudness function for each instrument on the platform on which the original MIDI sound file is played, i.e., the reference platform. The reference platform is capable of analyzing the input signal of the MIDI sound file through a signal processing interface, whether it is analog or digital. That is, a reference platform, by definition is able to accurately play the MIDI sound file in the manner in which the song or ring tone was meant to be heard. If the reference platform is a PC, then the reference will be to the loudness of the instruments on the PC. If the reference platform is a music synthesizer, then the reference will be to the loudness of the instruments on the music synthesizer.

The loudness function can be considered similar to an amplitude contour of the notes an instrument plays for the duration of the MIDI sound file composition, except the amplitude is a representation of the loudness level. The loudness level is the cube root of the decibel (dB) level as calculated in the ISO-532B, which is an international standard for a psycho-acoustic model which accounts for the sensitivities of the human auditory system, as promulgated by the International Organization for Standardization of Geneva, Switzerland. ISO-532B is defined by three main parts: 1) ISO-226 equal loudness contours (phon curves), 2) critical band filters and 3) non-linear compression. The loudness function can be calculated by employing these three techniques.

In this manner, a loudness function is calculated for any given input signal. Consequently, the loudness function is calculated for each instrument in the MIDI sound file. A loudness function is similar to a dB plot, except the values are in sones, the units of loudness, instead of phons.

In step 506, the loudness levels, or the audio output range, of the playing device are calculated. That is, the frequency response of the audio lineup of the playing device is calculated. The frequency response of a playing device such as a mobile telephone is very close to the reciprocal of the transfer function of the outer to middle human ear. The reciprocal of the transfer function of the outer to middle human ear has strong roll offs at the low and high end frequencies with relatively flat band-pass response with a bump at around 3–4 KHz.

There are a variety of ways to account for the frequency response of the playing device. One way to account for the frequency response of the playing device is to subtract the dB level of the playing device's frequency response in the loudness calculation. In the loudness calculation, the hearing level threshold, also known as the 3 dB curve, is the dB curve represented as phon levels, which describe the dB level at the threshold of hearing. In the loudness model, this dB curve is subtracted since subtraction in the log domain is equivalent to multiplication in the linear magnitude domain. Hence, log addition and subtraction can be used as a method to perform linear filtering.

Thus, in an embodiment of the present invention, the frequency response of the playing device is accounted for in the calculation of loudness of the playing device by subtraction of the dB level. As of the execution of step 506, a representation of loudness for each instrument in the MIDI sound file (as it would be played on the playing device) is garnered.

The MIDI specification supports 128 instruments each with adjustable volume levels between 1 and 127 and notes between 1 and 127. A note value of 60, for example, is the middle C note. Each note defines a certain frequency and each volume level defines a certain magnitude. It is therefore possible to pre-calculate a loudness level for any given note at any given volume on any given instrument for a particular sound-playing device. This pre-calculation is a brute force approach that requires a loudness mapping of the entire instrument set supported on the playing device. Thus, for each instrument there are at most 16,129 (or 127×127) possible loudness levels spanning the entire instrument note range and volume level range. Not all instruments support the full note range or full volume range. It is also necessary to calculate a loudness level mapping for each master volume level on the playing device since loudness is a function of level and frequency.

One can account for the frequency response of the playing device by: 1) taking this into account within the loudness calculation of the playing device or 2) completing a pre-calculation of instrument loudness prior to adjustment of loudness levels in the MIDI sound file. The latter method is a frequency response sweep of the loudness for the entire instrument set in the MIDI sound file. The sound-playing device can be placed in an isolated sound chamber and a microphone record the MIDI generated single musical note output signal. The playing device plays a MIDI composition that plays one instrument at a time. The instrument sweeps across all notes at all volume levels. For each note at each level the audio output loudness is recorded and analyzed. Each analysis window is analyzed using a loudness calculation such as the one described in ISO532B. Alternatively, each analysis window is analyzed using the loudness calculation process described below with reference to FIGS. 7–8. Hence, each instrument will have a loudness level associated with each note for each instruments' volume step, resulting in 16,129 (or 127×127) loudness levels per instrument. A polynomial fitting function or interpolation scheme can be used to reduce memory requirements.

This frequency response sweep measures the entire allowable loudness levels of the playing device and inherently includes any auditory equalization routines, or playing device response profiles, since it is an acoustic recording of the entire audio lineup configuration of the playing device. This instrument loudness mapping is calculated and stored in memory on the playing device. The playing device holds the loudness mapping in storage and can access it to automatically adjust the level of a MIDI sound file. Any modifications to the audio equalizers on the playing device would require a new loudness analysis of the playing device.

To automatically balance instrument volume levels the MIDI sound file must be evaluated, in step 506, as it is sounds on the reference device. This requires a calculation of the instrument loudness of the MIDI sound file as it is output by the reference device. A streaming audio output from the reference device may be analyzed, or a microphone can be set up to record the reference device as it outputs the MIDI sound file. In this setup, only the MIDI sound file must be analyzed. Not all possible combinations of instrument volume levels and notes are required as was the case for the mapping function on the playing device. Instrument isolation, however, is required.

A MIDI parser is used to isolate each MIDI instrument in the MIDI sound file. This is accomplished by examining the MIDI status and data bytes in the MIDI sound file and extracting only those MIDI hex instructions that correspond to the instrument under evaluation. Each instrument in the MIDI sound file is evaluated one at a time. The instrument loudness for each note of the entire MIDI sound file is calculated and compared to the loudness mapping function on the playing device. The loudness mapping function describes the required volume level of the instrument on the playing device in order to achieve the same loudness level as the reference device. The required volume level is recorded and compared to the MIDI sound file volume level. This difference reflects the amount of gain this MIDI instrument must provide to achieve a similar volume level on the playing device.

In step 508, a mapping of each instrument in the MIDI sound file to the audio output range of the playing device is generated, revealing the necessary level of volume change. In step 508 it is determined how to adjust the levels of each MIDI instrument of the sound file for optimal play on the playing device, such that its loudness level is the same as that on the reference platform. At this point, the loudness level for each instrument on the reference device has been computed and the loudness level for each instrument on the playing device has been computed.

A MIDI sound file contains, among other things, score information such as what instrument to play, what note to play, and how long to play the note. As in step 504, each instrument in the MIDI sound file can be isolated. For each note played by each instrument, the loudness of the note must be recalculated. (A note translates into a different frequency being played, resulting in a change in loudness. Recall, loudness is a function of level and frequency.) The note array structure in the MIDI sound file contains timing information and can be parsed to flag any note event changes. Each time a new note is played on an instrument a new loudness must be calculated and compared to the loudness of that note on the reference platform. This pair of loudness values constitutes a loudness mapping function from the reference platform to the playing device. For example:

| Instrument Note | Reference Loudness | Playing Device Loudness |
|---|---|---|
| GUITAR A | 20 sone | 22 sone |
| GUITAR B | 18 sone | 22 sone |

In step 510, a gain term for each note in the MIDI sound file is generated. That is, a gain term that adjusts for the loudness difference of each note in the MIDI sound file is generated based on the mapping generated in step 508. A gain term with a proper value levied against a note results in a loudness level that is equal in both the reference platform and playing device. A loudness calculation is performed for each gain value-note pair. An amplitude gain term is multiplicative in the linear magnitude domain. Recall that the log domain allows an addition to be equivalent to multiplication.

| Instrument Note | Ref Loudness | Playing Device Loudness | Gain Term |
|---|---|---|---|
| GUITAR A | 20 sone | 22 sone | 5 units |
| GUITAR B | 18 sone | 22 sone | 8 units |

As of the execution of step 510, a gain term for each note of the MIDI sound file is generated. In step 512, the MIDI sound file is modified using the gain terms such that the loudness levels of the MIDI sound file on the playing device are equivalent to the loudness levels on the reference platform. Since the MIDI sound file has been parsed for instrument and note information in steps 504–508 above, each note is modified using the gain term calculated in step 508. In an embodiment of the present invention, the hex notation of each note of the MIDI sound file is overwritten with the new gain adjusted levels. In step 514, the control flow of FIG. 5 stops.

Example Execution of MIDI File Transformation

Below is an example of the execution of the control flow of FIG. 5. In step 504, a loudness calculation is performed for the MIDI sound file. The resulting data is stored for future use. Next, in step 506, the loudness levels of the playing device are calculated. The resulting data is also stored for future use. Also, in step 506, a frequency response sweep is performed, where it is determined that note 23 at volume level 53 of the MIDI sound file exhibits a loudness of 25 sones when played on the reference device. Next, in step 508, a mapping of each instrument in the MIDI sound file to the audio output range of the playing device is generated, revealing the necessary level of volume change. This mapping, consisting of a 127×127 table corresponding to 127 volume levels multiplied by 127 notes, is stored on the playing device.

Next, in step 510, a gain term for each note of the MIDI sound file is generated. By referring to the table generated in step 508, it is determined that note 23 at 25 sones corresponds to a loudness level of 56 on the playing device. Thus, the gain term from the reference device to the playing device for note 23 at 25 sones is +3, since the loudness level changed from 53 on the reference device to 56 on the playing device (56−53=3). In step 512, the MIDI sound file is modified using the gain terms such that the loudness levels of the MIDI sound file on the playing device are equivalent to the loudness levels on the reference platform. Each note is modified using the gain term calculated in step 508. For example, the loudness of note 23 at 25 sones is increased by the gain term +3. In step 514, the control flow of FIG. 5 stops.

Loudness Calculation

In a first step, the power spectral estimate for the analysis window is computed. This is generally accomplished by windowing the analysis region, calculating the Fast Fourier Transform, and computing its squared magnitude. Thus, the power spectral estimate X(w) is calculated from x(t) using Fourier Analysis where w denotes frequency and t denotes time. This is a standard technique known to one of ordinary skill in the art.

In a second step, the power spectrum is integrated within overlapping critical band filter responses. Many types of critical band filter forms can be used for this step, including triangular, bell-shaped, or square filter forms. Most are based on a frequency scale that is linear below 1 KHz and essentially logarithmic above 1 KHz. The critical band scale corresponds to filter banks separated at 1 Bark intervals. Additionally, there are a variety of known power spectrum warping functions that provide critical band filter analysis. Also, ⅓ octave filter banks are considered an adequate approximation to the critical band spectrum. The result of the second step a calculation of the power spectrum energy on a critical band scale.

Figure 7:
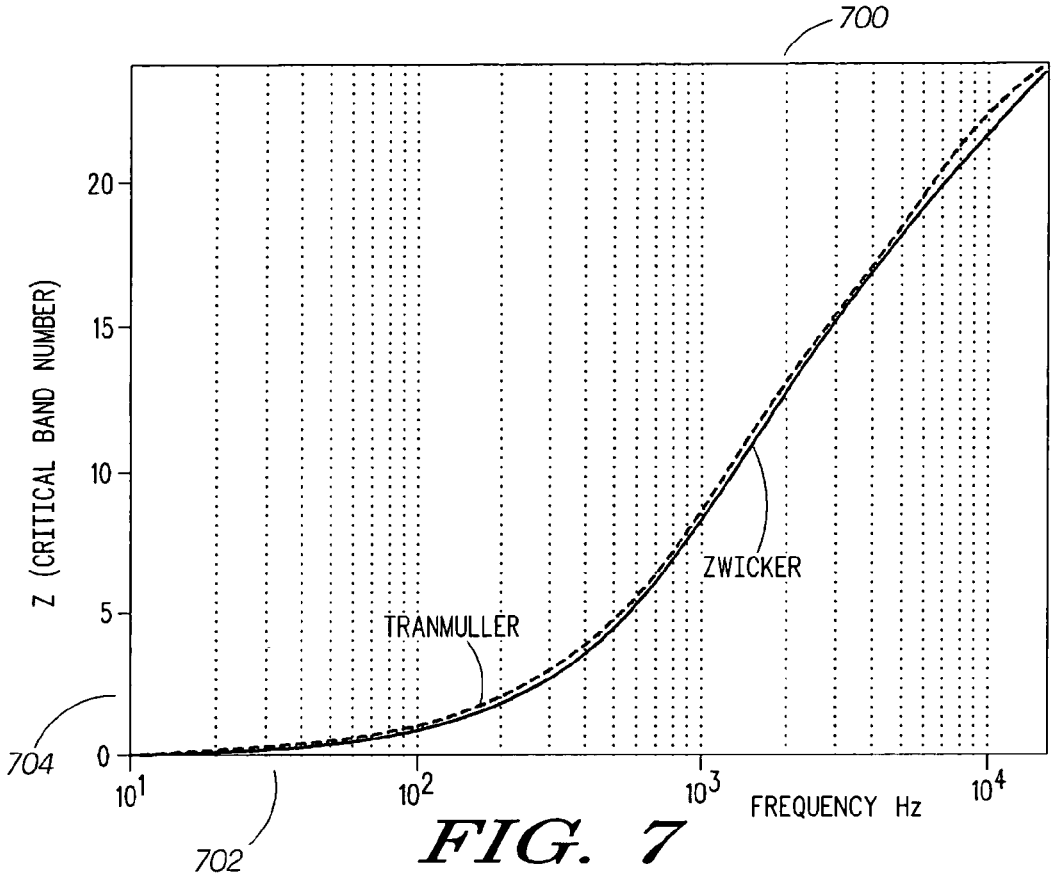
FIG. 7 shows a graph representing a mapping of a linear frequency scale to a critical band scale.

FIG. 7 shows a graph 700 representing a mapping of a linear frequency scale to a critical band scale. The x-axis 702 of the graph 700 represents the linear frequency while the y-axis represents the critical band scale. Critical band integration requires a mapping of the linear frequency range to a range approximating the sensitivity of human hearing. A variety of critical band mapping functions are available in the art of the present invention.

In a third step, a calculation is performed in order to compensate for the unequal sensitivity of human hearing at different frequencies. A pre-emphasis type filter that accounts for the unequal loudness contour of human hearing is used in this step. This step can also be calculated as a simple weighting of the elements of the critical band power spectrum.

Figure 8:
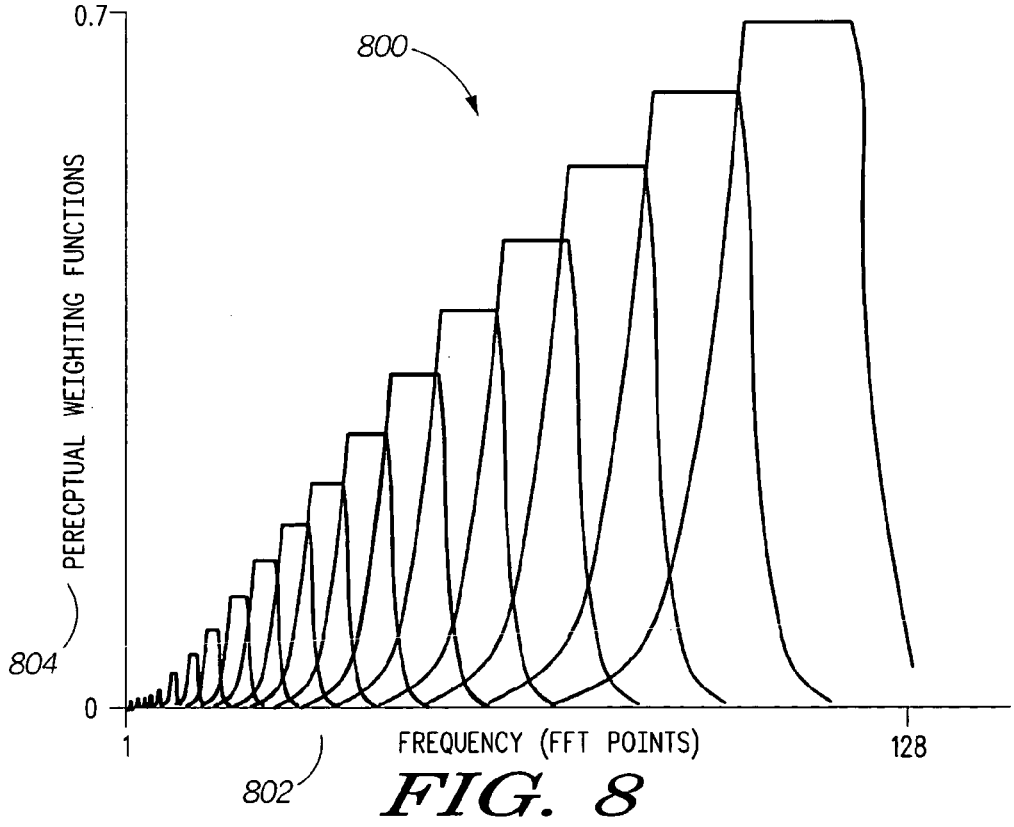
FIG. 8 shows a graph representing a combined frequency response of critical band filters with pre-emphasis weighting.

FIG. 4, as described above, shows equal loudness contours that define curves along which equal loudness is perceived. The effect of these curves can be included as weighting scales of the critical band filters as seen in FIG. 8. FIG. 8 shows a graph 800 representing a combined frequency response of critical band filters with pre-emphasis weighting. The x-axis 802 of the graph 800 represents the combined frequency response while the y-axis represents the perceptual weighting functions. The combined frequency response of critical band filters with pre-emphasis weighting is represented by the function H(w). The weighting can be added in the frequency domain to include the unequal sensitivity of human hearing at different frequencies. Without weighting, the filters would all be at the same level. The power spectrum, X(w), is modified to include critical band integration and unequal frequency sensitivity as:

$$Y(w)=X(w)\times H(w)$$

In a fourth step, the spectral amplitudes is compressed in accordance with the power law of hearing. Generally, a log function or a cube root function is applied to the critical band auditory spectrum. Compression effectively reduces the dynamic range of the critical band power spectrum. The effect of this step is to reduce the amplitude variations for the spectral resonances in accordance with the sensitivity of human hearing which itself imparts a sort of smearing or masking effect.

For example, a cube root is applied to the critical band and pre-emphasized power spectrum, as:

$$Z(w)=[Y(w)]\hat{}\,⅓$$

In a fifth step, the total loudness is the sum of the specific loudness units. The energy in each critical band filter represents a specific loudness unit and together the summation represents the total loudness.

For example, the total loudness is the sum of critical band energies calculated in the previous step:

$$N=\mathrm{sum}(Z(w))$$

Exemplary Implementations

Figure 6:
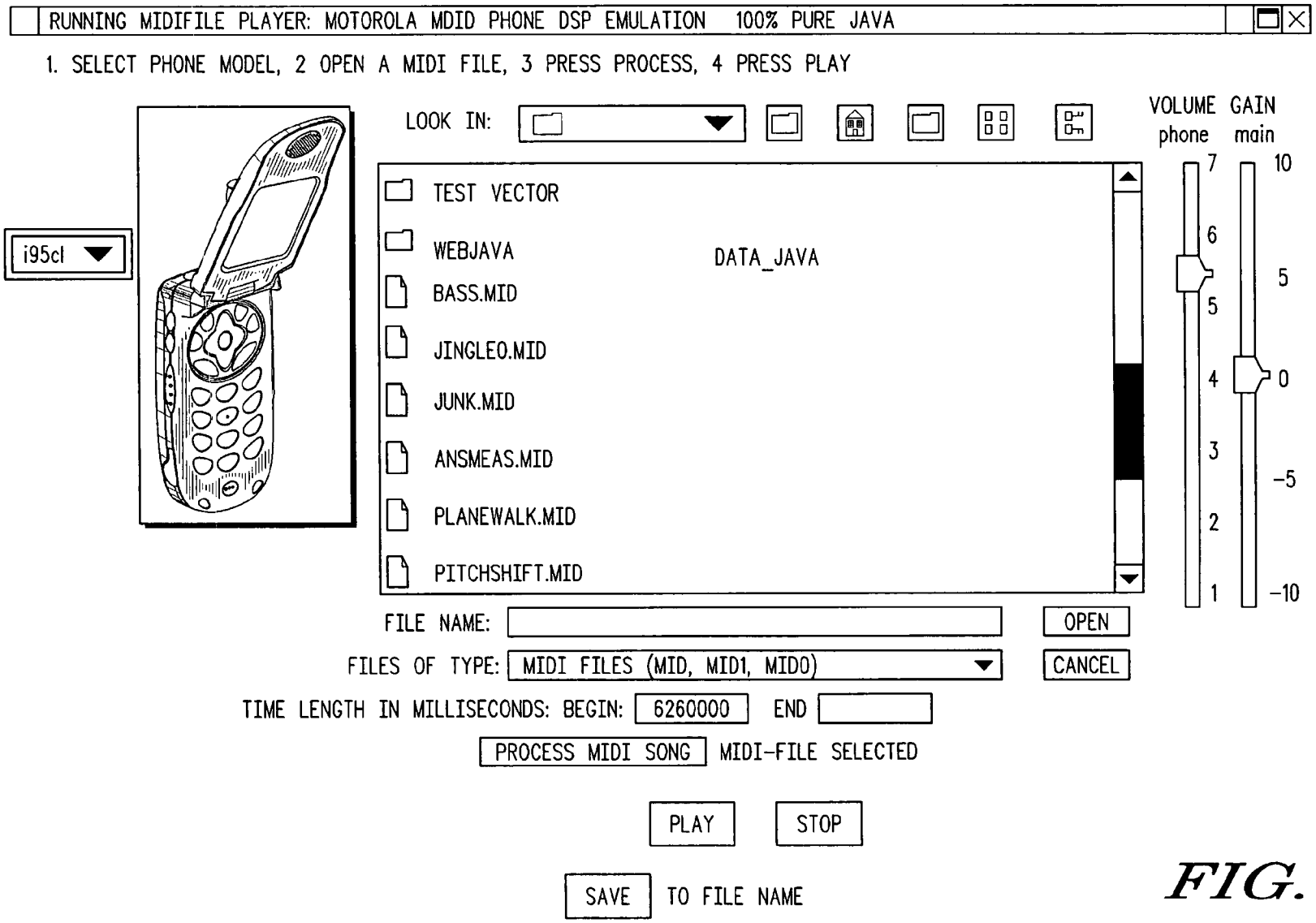
FIG. 6 is a screenshot of the graphical user interface of a software component used for adjusting the volume levels of a MIDI file for optimal play on a sound device.

FIG. 6 is a screenshot of the graphical user interface 600 of a software component used for adjusting the volume levels of a MIDI file for optimal play on a sound device. The software component of FIG. 6 may reside on a personal computer 110, a sound device such as the mobile telephone 106 or a server connected to the wireless service provider 102.

FIG. 6 shows that the graphical user interface 600 includes a selection window 604 that includes a variety of MIDI sound files for selection. The MIDI sound files can include ring tones or songs. A user may select a MIDI sound file from the selection window 604 for processing. FIG. 6 shows that the graphical user interface 600 includes a pull down menu button 602 wherein the user may scroll through a series of sound devices, specifically mobile telephones, to identify and select the mobile telephone on which the user desires to play the selected MIDI sound file.

Once the desired MIDI sound file is selected and the appropriate mobile telephone 602 is selected, the user may proceed to press the "Process MIDI song" button 606. Upon pressing of the "Process MIDI song" button 606, the software component of the graphical user interface 600 processes the selected MIDI sound file so as to adjust the volume levels of the selected MIDI file for optimal play on the selected mobile telephone, as described in more detail with reference to FIG. 5 above.

The present invention can be realized in hardware, software, or a combination of hardware and software in the wireless device 300, the personal computer 110 or the wireless service provider 102. A system according to a preferred embodiment of the present invention can be realized in a centralized fashion in one computer system (of the wireless device 300, the personal computer 110 or the wireless service provider 102), or in a distributed fashion where different elements are spread across several interconnected computer systems. Any kind of computer system—or other apparatus adapted for carrying out the methods described herein—is suited. A typical combination of hardware and software could be a general purpose processor with a computer program that, when being loaded and executed, controls the processor such that it carries out the methods described herein.

The present invention can also be embedded in a computer program product (e.g., in the wireless device 300, the personal computer 110 or the wireless service provider 102), which comprises all the features enabling the implementation of the methods described herein, and which—when loaded in a system—is able to carry out these methods. Computer program means or computer program in the present context mean any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include non-volatile memory, such as ROM, Flash memory, Disk drive memory, CD-ROM, and other permanent storage. Additionally, a computer medium may include, for example, volatile storage such as RAM, buffers, cache memory, and network circuits. Furthermore, the computer readable medium may comprise computer readable information in a transitory state medium such as a network link and/or a network interface, including a wired network or a wireless network that allow a computer to read such computer readable information.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A method on an information processing system for adjusting volume levels of a Musical Instrument Digital Interface (MIDI) sound file for optimizing play on a sound device, the method comprising:

calculating a first set of loudness levels for each instrument in a MIDI sound file;

calculating a second set of loudness levels corresponding to an audio output range of a sound device;

generating a mapping between the first set of loudness levels and the second set of loudness levels corresponding to the audio output range of the sound device;

generating a gain term for each note in the MIDI sound file; and modifying the MIDI sound file using the second set of loudness levels and the gain term for each note in the MIDI sound file.

2. The method of claim 1, wherein the information processing system is a computer and wherein the sound device is a mobile telephone.

3. The method of claim 1, wherein the calculating a second set further comprises:

calculating a second set of loudness levels corresponding to an audio output range of the sound device, wherein the audio output range is a reciprocal of a transfer function of a human ear.

4. The method of claim 3, wherein the calculating a second set further comprises:

subtracting the decibel level of the audio output range of the sound device from the second set of loudness levels.

5. The method of claim 1, wherein the MIDI sound file includes at least one of a ring tone and a song.

6. The method of claim 1, wherein the generating of a mapping further comprises:

generating a mapping between the first set of loudness levels and the second set of loudness levels corresponding to the audio output range of the sound device, wherein the mapping includes one-to-one correspondence between the first set of loudness levels and the second set of loudness levels.

7. The method of claim 1, wherein the modifying further comprises:

generating a new MIDI sound file comprising the second set of loudness levels integrated with the gain term for each note in the MIDI sound file.

8. An information processing system for adjusting volume levels of a Musical Instrument Digital Interface (MIDI) sound file for optimizing play on a sound device, comprising:

a processor configured for performing:

calculating a first set of loudness levels for each instrument in a MIDI sound file;

calculating a second set of loudness levels corresponding to an audio output range of a sound device;

generating a mapping between the first set of loudness levels and the second set of loudness levels corresponding to the audio output range of the sound device;

generating a gain term for each note in the MIDI sound file; and modifying the MIDI sound file using the second set of loudness levels and the gain term for each note in the MIDI sound file.

9. The information processing system of claim 8, wherein the information processing system is a computer and wherein the sound device is a mobile telephone.

10. The information processing system of claim 8, wherein the processor is further configured for performing:

calculating a second set of loudness levels corresponding to an audio output range of the sound device, wherein the audio output range is a reciprocal of a transfer function of a human ear.

11. The information processing system of claim 10, wherein the processor is further configured for performing:

subtracting the decibel level of the audio output range of the sound device from the second set of loudness levels.

12. The information processing system of claim 8, wherein the MIDI sound file includes at least one of a ring tone and a song.

13. The information processing system of claim 8, wherein the processor is further configured for performing:

generating a mapping between the first set of loudness levels and the second set of loudness levels corresponding to the audio output range of the sound device, wherein the mapping includes one-to-one correspondence between the first set of loudness levels and the second set of loudness levels.

14. The information processing system of claim 8, wherein the processor is further configured for performing:

generating a new MIDI sound file comprising the second set of loudness levels integrated with the gain term for each note in the MIDI sound file.

15. A server for adjusting volume levels of a Musical Instrument Digital Interface (MIDI) sound file for optimizing play on a sound device, wherein the server is connected to a wireless network, the server comprising:

a processor configured for performing for performing:

calculating a first set of loudness levels for each instrument in a MIDI sound file;

calculating a second set of loudness levels corresponding to an audio output range of a sound device;

generating a mapping between the first set of loudness levels and the second set of loudness levels corresponding to the audio output range of the sound device;

generating a gain term for each note in the MIDI sound file; and modifying the MIDI sound file using the second set of loudness levels and the gain term for each note in the MIDI sound file.

16. The server of claim 15, further comprising:

a transmitter for transmitting the MIDI sound file that was modified to a sound device via the wireless network.

17. The server of claim 15, wherein the information processing system is a computer and wherein the sound device is a mobile telephone.

18. The server of claim 15, wherein the processor is further configured for performing:

calculating a second set of loudness levels corresponding to an audio output range of the sound device, wherein the audio output range is a reciprocal of a transfer function of a human ear.

19. The server of claim 15, wherein the processor is further configured for performing:

generating a mapping between the first set of loudness levels and the second set of loudness levels corresponding to the audio output range of the sound device, wherein the mapping includes one-to-one correspondence between the first set of loudness levels and the second set of loudness levels.

20. The server of claim 15, wherein the processor is further configured for performing:

generating a new MIDI sound file comprising the second set of loudness levels integrated with the gain term for each note in a MIDI sound file.

* * * * *